US007971873B2

(12) United States Patent
Ito

(10) Patent No.: US 7,971,873 B2
(45) Date of Patent: Jul. 5, 2011

(54) IMAGE FORMING DEVICE

(75) Inventor: Sakae Ito, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 154 days.

(21) Appl. No.: 12/265,974

(22) Filed: Nov. 6, 2008

(65) Prior Publication Data

US 2009/0121414 A1 May 14, 2009

(30) Foreign Application Priority Data

Nov. 8, 2007 (JP) ..... 2007-291002

(51) Int. Cl.
*B65H 31/00* (2006.01)
*G03G 21/18* (2006.01)

(52) U.S. Cl. ..... 271/207; 271/209; 399/114

(58) Field of Classification Search ..... 271/207, 271/209, 213; 399/405, 25, 114; 207/209, 207/213

See application file for complete search history.

(56) References Cited

U.S. PATENT DOCUMENTS

| | | | | |
|---|---|---|---|---|
| 6,408,147 | B1 * | 6/2002 | Oshida | 399/82 |
| 7,099,618 | B2 * | 8/2006 | Iwago et al. | 399/367 |
| 7,463,860 | B2 * | 12/2008 | Nobe et al. | 399/405 |
| 7,484,729 | B2 * | 2/2009 | Ono et al. | 271/209 |
| 7,688,484 | B2 * | 3/2010 | Tokuda | 358/498 |
| 2004/0062583 | A1 * | 4/2004 | Kameyama et al. | 399/405 |
| 2004/0126136 | A1 * | 7/2004 | Toba et al. | 399/114 |
| 2005/0047842 | A1 * | 3/2005 | Nobe | 399/405 |
| 2005/0140086 | A1 * | 6/2005 | Ono et al. | 271/207 |
| 2006/0018693 | A1 * | 1/2006 | Nobe et al. | 399/405 |
| 2006/0269320 | A1 * | 11/2006 | Ishii | 399/116 |
| 2008/0226339 | A1 * | 9/2008 | Sato | 399/114 |
| 2009/0116889 | A1 * | 5/2009 | Ishii | 399/405 |
| 2010/0098459 | A1 * | 4/2010 | Hoashi | 399/114 |

FOREIGN PATENT DOCUMENTS

| | | |
|---|---|---|
| JP | 4-72247 | 3/1992 |
| JP | 6-9101 | 1/1994 |
| JP | HEI 09-040187 | 2/1997 |
| JP | HEI 11-222349 | 8/1999 |
| JP | HEI 11-301059 | 11/1999 |
| JP | 2000-219382 | 8/2000 |
| JP | 2000-255826 | 9/2000 |
| JP | 2002-196653 | 7/2002 |
| JP | 2006-36437 | 2/2006 |

OTHER PUBLICATIONS

Japanese Official Action dated Nov. 5, 2009 with English translation.

* cited by examiner

*Primary Examiner* — Kaitlin S Joerger
*Assistant Examiner* — Patrick Cicchino
(74) *Attorney, Agent, or Firm* — Scully, Scott, Murphy & Presser, PC

(57) ABSTRACT

An image forming device, which is configured to form an image on a sheet, includes a main body casing, a catch tray provided on the main body casing to be loaded with the sheet discharged in a first direction with the image formed thereon, and a cover configured to cover a downstream-side face of the main body casing in the first direction in an openable and closable manner. The catch tray is disposed such that a downstream-side end thereof in the first direction faces an upstream-side end of the cover in the first direction. The downstream-side end of the catch tray and the upstream-side end of the cover are configured to mutually overlap when viewed in a second direction perpendicular to the first direction and a vertical direction.

11 Claims, 12 Drawing Sheets

IMAGE FORMING DEVICE

CROSS-REFERENCE TO RELATED APPLICATION

This application claims priority under 35 U.S.C. §119 from Japanese Patent Application No. 2007-291002 filed on Nov. 8, 2007. The entire subject matter of the application is incorporated herein by reference.

BACKGROUND

1. Technical Field

The following description relates to one or more image forming devices such as printers, copy machines, and fax machines.

2. Related Art

An image forming device such as a printer has been known, which includes a catch tray provided on a main body casing thereof to be loaded with a discharged sheet with an image formed thereon, and a cover attached at a downstream-side end of the main body casing in a sheet discharging direction in an openable and closable manner (see Japanese Patent Provisional Publication No. 2006-36437).

In the meantime, a sheet is conveyed while being curled by a plurality of rollers inside the main body casing, and therefore may be discharged in a state curled with a front end thereof down. In this regard, in the known image forming device, mutually facing surfaces of the catch tray and the cover are, respectively, formed as planes along a direction perpendicular to the sheet discharging direction and a vertical direction, and a gap between the catch tray and the cover is formed linearly along the above perpendicular direction. Therefore, the front end of the curled sheet is likely to enter into the linearly formed gap, and it might cause a trouble that the sheet cannot smoothly be discharged, such as a paper jam.

SUMMARY

In order to avoid the aforementioned trouble, some ways are considered, such as a way in which the catch tray and the cover are disposed so close to each other that the front end of the sheet cannot enter the gap therebetween, and a way in which an end portion of the cover is covered with an end portion of the catch tray to mask the gap. However, these ways result in that the cover cannot smoothly be opened and closed.

Aspects of the present invention are advantageous to provide one or more improved image forming devices that make it possible to smoothly discharge a sheet.

According to aspects of the present invention, an image forming device configured to form an image on a sheet is provided, which includes a main body casing, a catch tray provided on the main body casing to be loaded with the sheet discharged in a first direction with the image formed thereon, and a cover configured to cover a downstream-side face of the main body casing in the first direction in an openable and closable manner. The catch tray is disposed such that a downstream-side end thereof in the first direction faces an upstream-side end of the cover in the first direction. The downstream-side end of the catch tray and the upstream-side end of the cover are configured to mutually overlap when viewed in a second direction perpendicular to the first direction and a vertical direction.

In some aspects of the present invention, the downstream-side end of the catch tray and the upstream-side end of the cover, which face each other, at least partially overlap when viewed in the second direction perpendicular to the first direction and a vertical direction. Therefore, than a known image forming device in which a gap between a catch tray and a cover is formed linearly along the second direction, it is so harder for a leading end of a sheet discharged to enter into the gap between the catch tray and the cover that the sheet can be discharged more smoothly.

BRIEF DESCRIPTION OF THE ACCOMPANYING DRAWINGS

DETAILED DESCRIPTION

Figure 1:
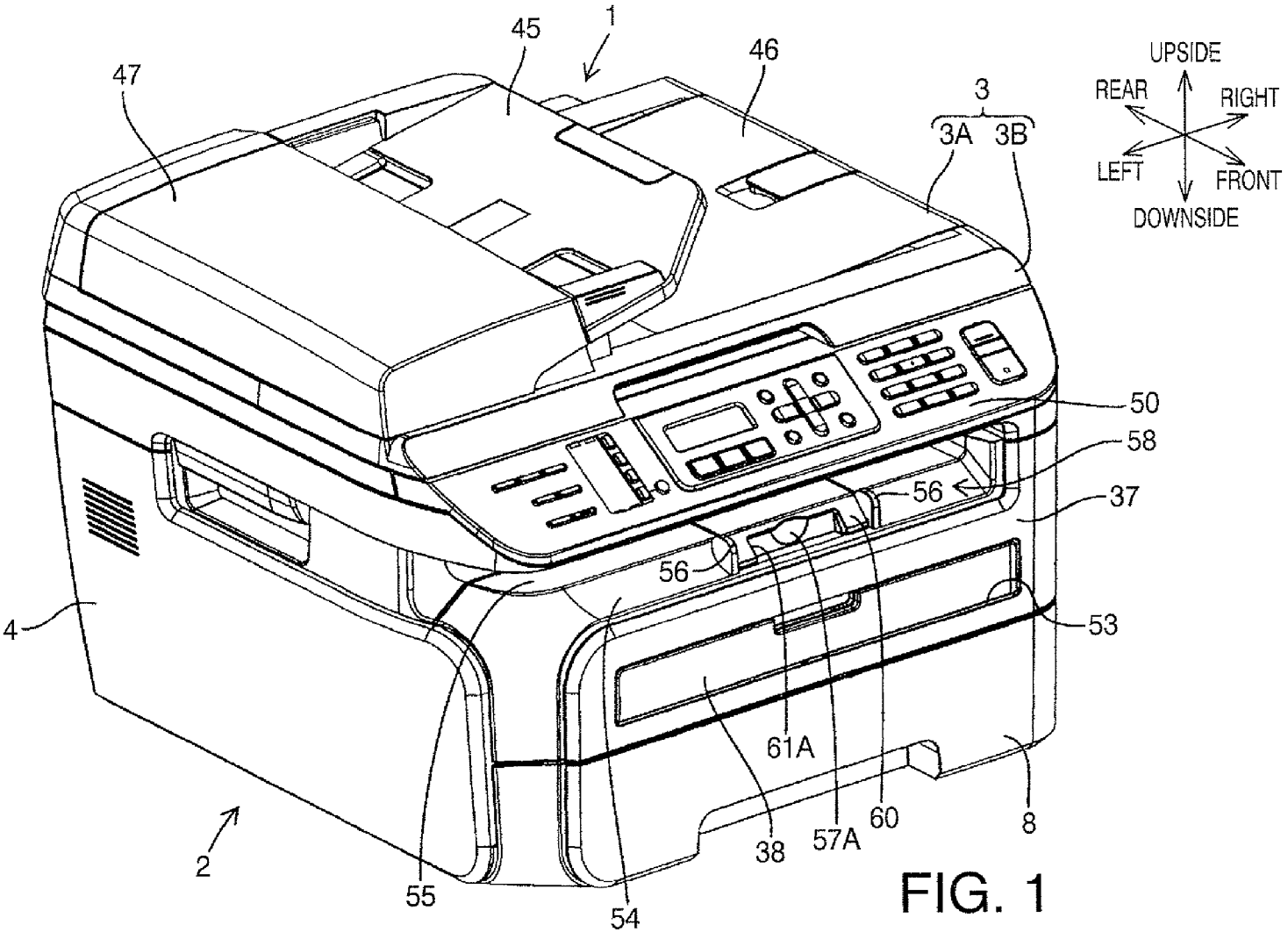
FIG. 1 is a perspective view of an image forming device in an embodiment according to one or more aspects of the present invention.
Figure 2:
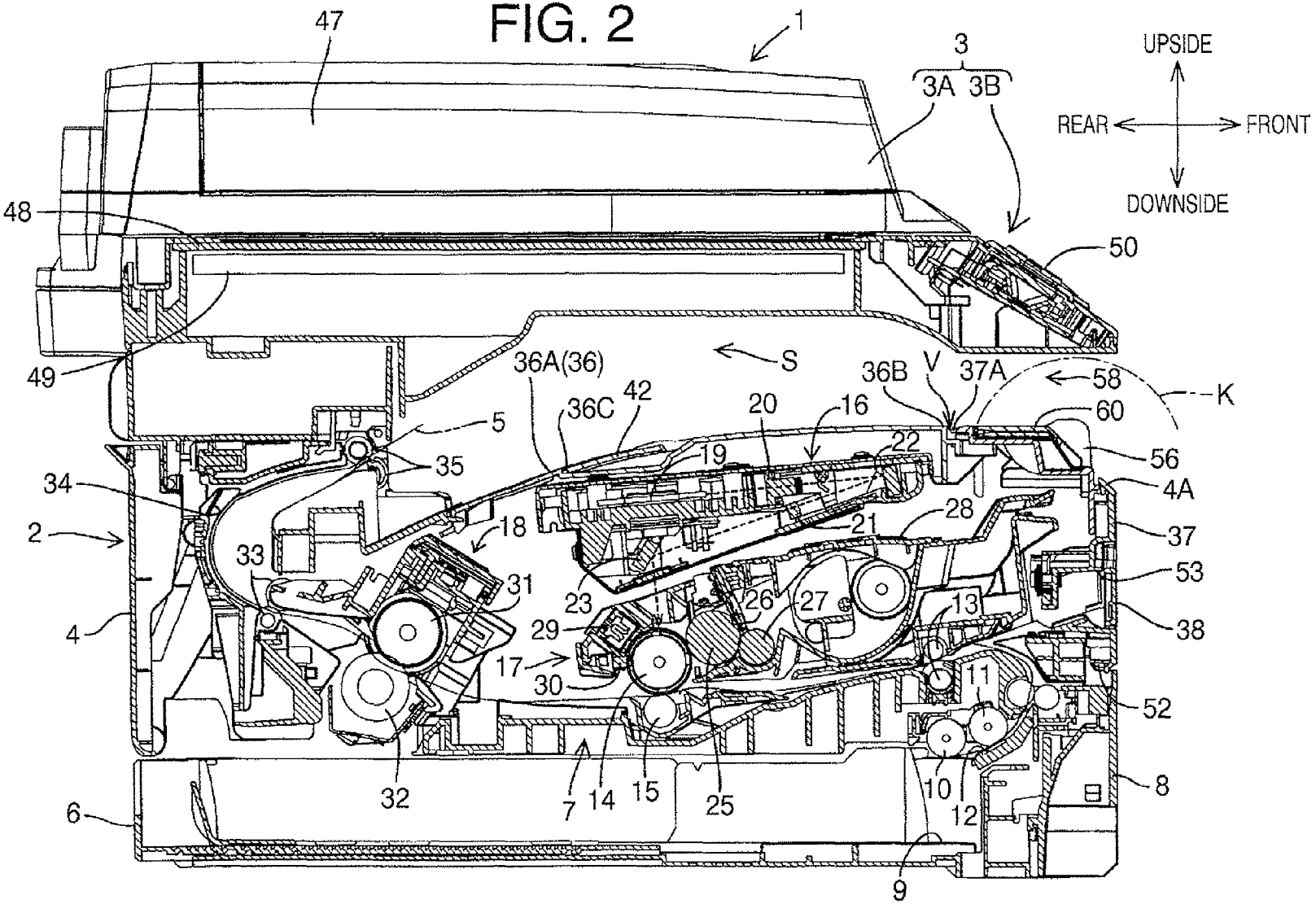
FIG. 2 is a cross-sectional side view showing a major portion of the image forming device in the embodiment according to one or more aspects of the present invention.

It is noted that various connections are set forth between elements in the following description. It is noted that these connections in general and, unless specified otherwise, may be direct or indirect and that this specification is not intended to be limiting in this respect. Hereinafter, an embodiment according to aspects of the present invention will be described with reference to the accompany drawings. Firstly, referring to FIGS. 1 and 2, an overall configuration of an image forming device 1 in an embodiment will be described. FIG. 1 is a perspective view schematically showing an external view of the image forming device 1. FIG. 2 is a cross-sectional side view showing a major portion of the image forming device 1. In the following description, a right side and a left side in FIG.

2 will be defined as a front side and a rear side of the image forming device 1, respectively.

The image forming device 1 in the present embodiment is a multifunction peripheral provided with a printer function, a copy function, and a scanner function. The image forming device 1 includes a device main body 2 and a cover 3 attached to cover an upper face of the device main body 2.

(Device Main Body)

The device main body 2 is provided with a main body casing 4 formed substantially in a box shape as a whole. The main body casing 4 includes a feeder 6 configured to feed a sheet 5 such as a paper and an OHP transparent sheet and an image forming unit 7 configured to form an image on the sheet 5 fed.

The feeder 6 includes a sheet feed tray 8, a sheet pressing plate 9, a pickup roller 10, a sheet feed roller 11, a separation pad 12, and registration rollers 13.

The sheet pressing plate 9 is configured to be loaded with a stack of sheets 5, and supported swingably around a far end (rear end) thereof from the sheet feed roller 11. The sheet pressing plate 9 is biased upward by a spring (not shown), and thereby a top one of the stack of sheets 5 on the sheet pressing plate 9 is pressed against the pickup roller 10. Then, the top sheet 5 is fed by rotation of the pickup roller 10 toward between the sheet feed roller 11 and the separation pad 12. The sheet 5 is pinched between the sheet feed roller 11 and the separation pad 12, and thereafter fed on a sheet-by-sheet basis.

After that, the sheet 5 is fed to the registration rollers 13, which performs registration for the sheet 5 and then feeds the sheet 5 to an image forming position. It is noted that the image forming position is a transfer position in which a toner image on a photoconductive drum 14 is transferred onto the sheet 5, and in the present embodiment, corresponds to a contact position between the photoconductive drum 14 and a transfer roller 15.

The image forming unit 7 includes a scanner unit 16, a process cartridge 17, and a fixing unit 18. The scanner unit 16 is provided with a laser emitting unit (not shown), a polygon mirror 19, lenses 20 and 21, reflecting mirrors 22 and 23. A laser beam emitted by the laser emitting unit, as indicated by a dashed line, is incident onto a surface of the photoconductive drum 14 via deflection by the polygon mirror 19, transmission through the lens 20, reflection by the reflecting mirror 22, transmission through the lens 21, and reflection by the reflecting mirror 23 in the above cited order.

The process cartridge 17 includes a development roller 25, a layer thickness regulating blade 26, a supply roller 27, and a toner hopper 28. On a front face of the main body casing 4, a front cover 37 is provided in an openable and closable manner. By opening the front cover 37, the process cartridge 17 can be detached from the main body casing 4.

Toner in the toner hopper 28 is agitated by an agitator (not shown) and discharged outside the toner hopper 28. The discharged toner is supplied onto the development roller 25 through rotation of the supply roller 27, and positively charged between the supply roller 27 and the development roller 25. Further, the toner supplied onto the development roller 25 is held on the development roller 25 as a thin layer whose thickness is regulated by the layer thickness regulating blade 26.

The process cartridge 17 further includes the photoconductive drum 14, a scorotron type charger 29, the transfer roller 15, and a cleaning brush 30. After being positively charged by the charger 29, the surface of the photoconductive drum 14 is exposed to the laser beam from the scanner unit 16 to form an electrostatic latent image thereon. Subsequently, the toner held on the surface of the development roller 25 is supplied to the electrostatic latent image formed on the photoconductive drum 14 and developed. The cleaning brush 30 is configured to be biased with a cleaning bias voltage and to electrically collect and remove paper dusts adhered to the photoconductive drum 14.

The fixing unit 18 is configured to thermally fix the toner transferred onto the sheet 5 while the sheet 5 is passing between a heating roller 31 and a pressing roller 32 and to convey the sheet 5 to a sheet discharging path 34 with a carrying roller 33. On the main body casing 4, a catch tray 36 is formed. The sheet 5 conveyed to the sheet discharging path is fed onto the catch tray 36 by sheet discharging rollers 35.

The catch tray 36 is provided substantially in a central region on the main body casing 4 in a width direction. Further, the catch tray 36 includes a rectangular sheet loading surface 36A elongated in a front-to-rear direction. The sheet loading surface 36A is tilted to be higher at a front end side thereof, and has a steeper slope at a rear side thereof and a gentler slope at a front side. The aforementioned sheet discharging roller 35 is disposed at an upper side of a rear end of the sheet loading surface 36A. By the sheet discharging roller 35, the sheet 5 is discharged from the rear side to the front side, and put onto the sheet loading surface 36A.

(Cover)

The cover 3 is provided above the catch tray 36 via a discharge space S. The cover 3 is configured with an upper cover 3A arranged on a top of a lower cover 3B. Further, the cover 3 is placed on the main body casing 4 to wholly cover the upper face of the main body casing 4.

At a left end of the upper cover 3A, an automatic document feeder (ADF) 47 is provided. The ADF 47 is configured to feed documents stacked on a document tray 45, make a below-mentioned image sensor 49 scan the documents, and discharge the documents scanned onto a document catch tray 46. The document tray 45 protrude in a plate shape to form a slope extending from the ADF 47 obliquely toward an upper right side, and is configured to be loaded with a stack of documents thereon. In addition, the document catch tray 46 is formed under the document tray 45 substantially throughout an entire width of the cover 3, extending horizontally from the ADF 47 toward the right side, so as to hold a stack of scanned documents to be discharged from the ADF 47. The upper cover 3A is configured such that a front end thereof is openable and closable in a vertical direction (an upside-to-down-side direction) around a shaft (not shown) provided at a lower rear end.

The lower cover 3B includes a transparent glass plate 48 provided thereon, on which a document to be scanned is placed. The glass plate 48 is exposed when the upper cover 3A is opened. Under the glass plate 48, the image sensor 49 is provided to scan an image formed on the document as image data. Further, at a front end of the lower cover 3B, an operation unit 50 is provided, which includes a plurality of switches and buttons for operating the image forming device 1. The lower cover 3B is configured such that a front end thereof is openable and closable in the vertical direction around a support (not shown) provided at a lower rear end thereof. In addition, the discharge space S is formed between a bottom face of the lower cover 3B and the sheet loading surface 36A of the catch tray 36. Namely, the image forming device 1 is an in-body discharge type with the discharge space S formed substantially in a central region of a front face thereof.

(Regarding Front Cover and Catch Tray)

Figure 3:
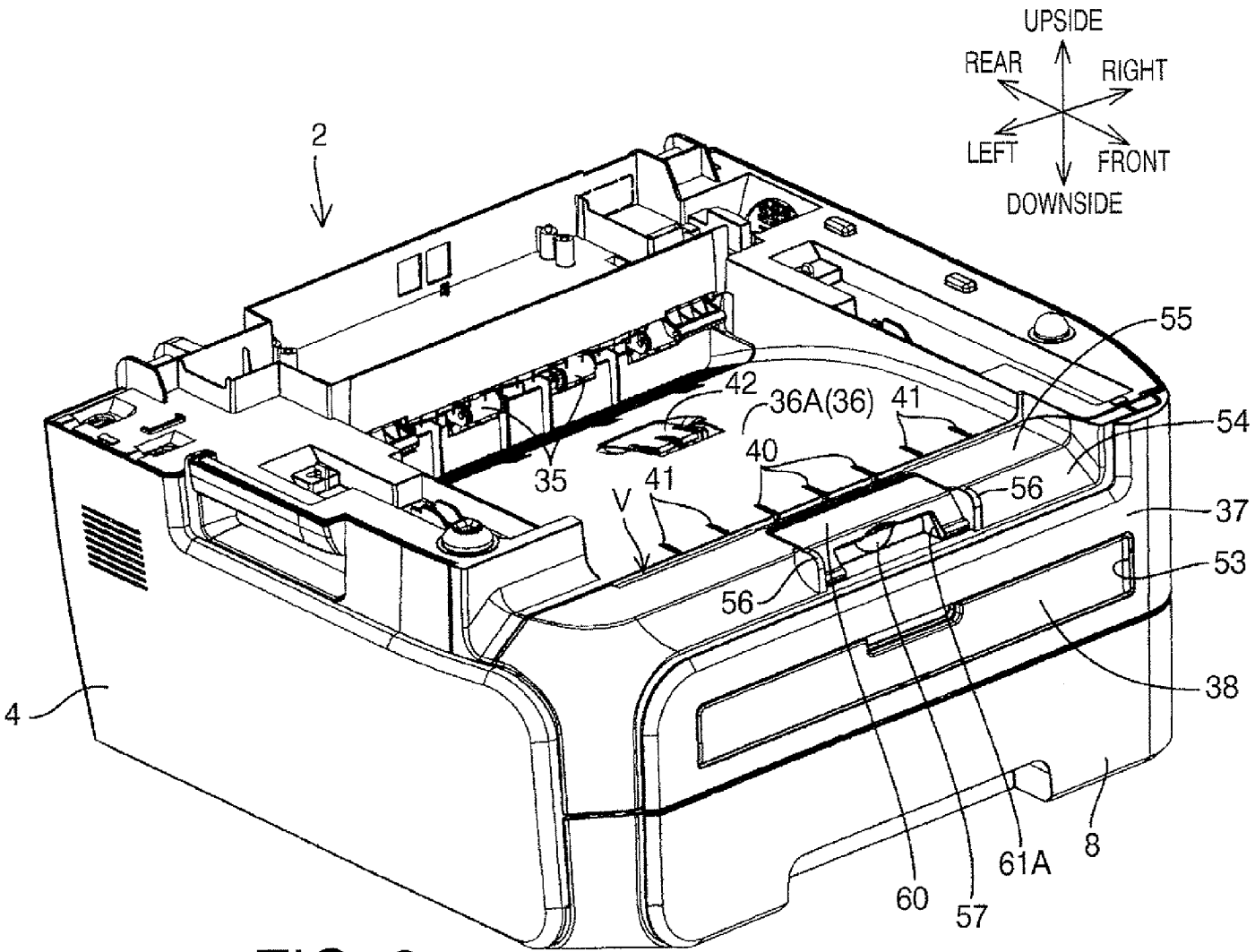
FIG. 3 is a perspective view showing a device main body of the image forming device in a state where a front cover of the image forming device is closed in the embodiment according to one or more aspects of the present invention.
Figure 4:
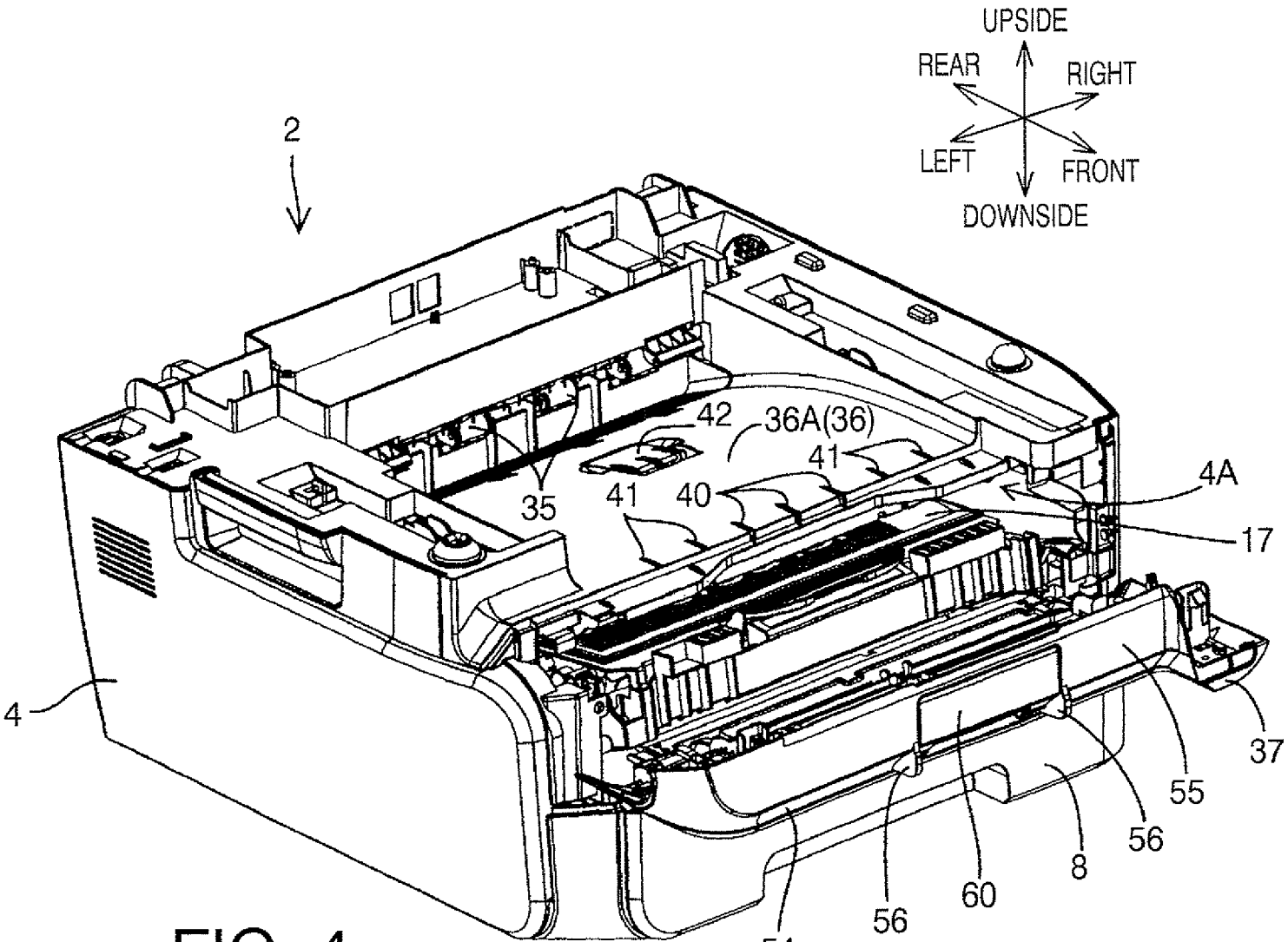
FIG. 4 is a perspective view showing the device main body of the image forming device in a state where the front cover is closed in the embodiment according to one or more aspects of the present invention.
Figure 5:
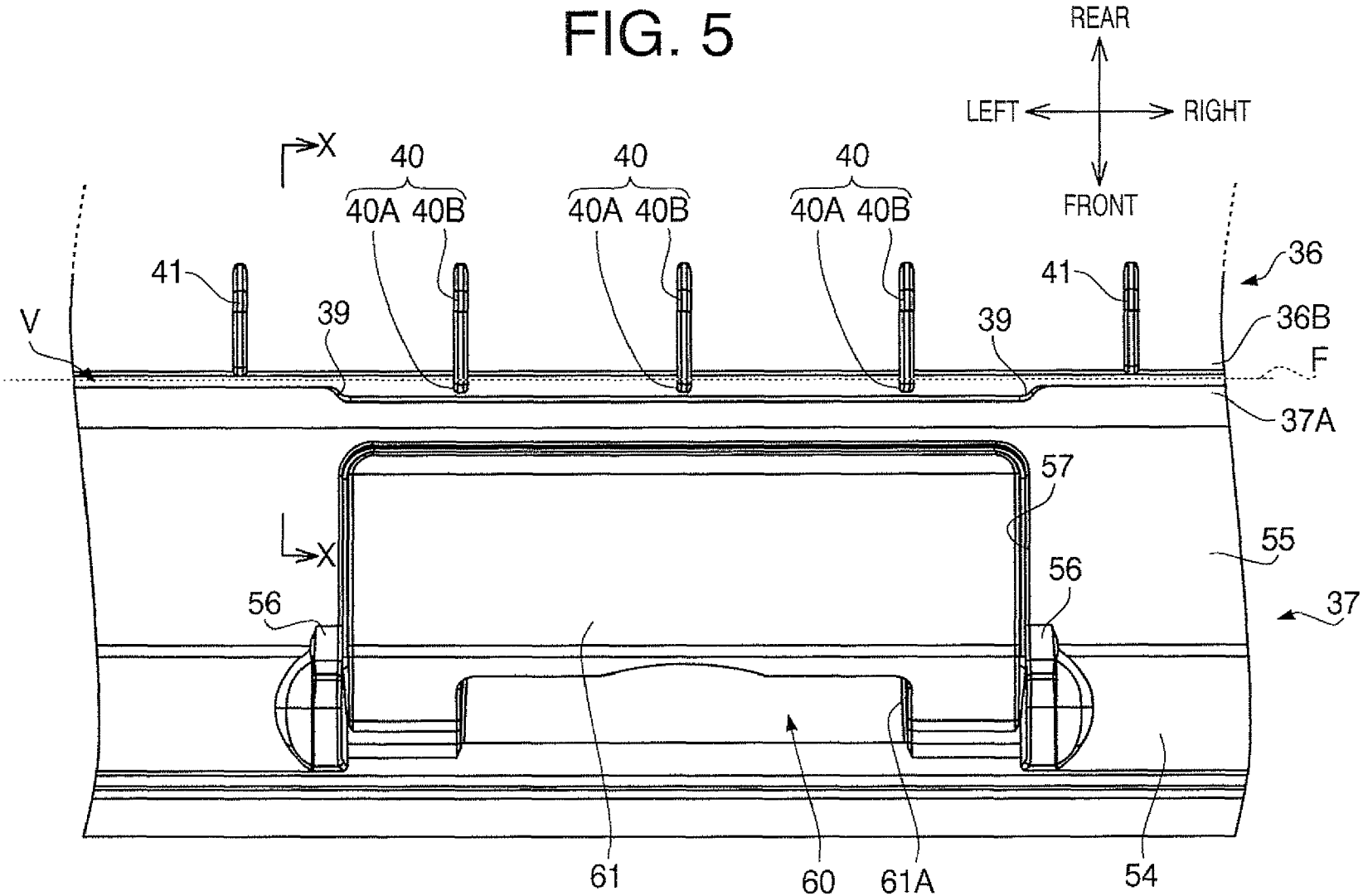
FIG. 5 is an enlarged view showing mutually facing portions of a catch tray and the front cover in the embodiment according to one or more aspects of the present invention.
Figure 6:
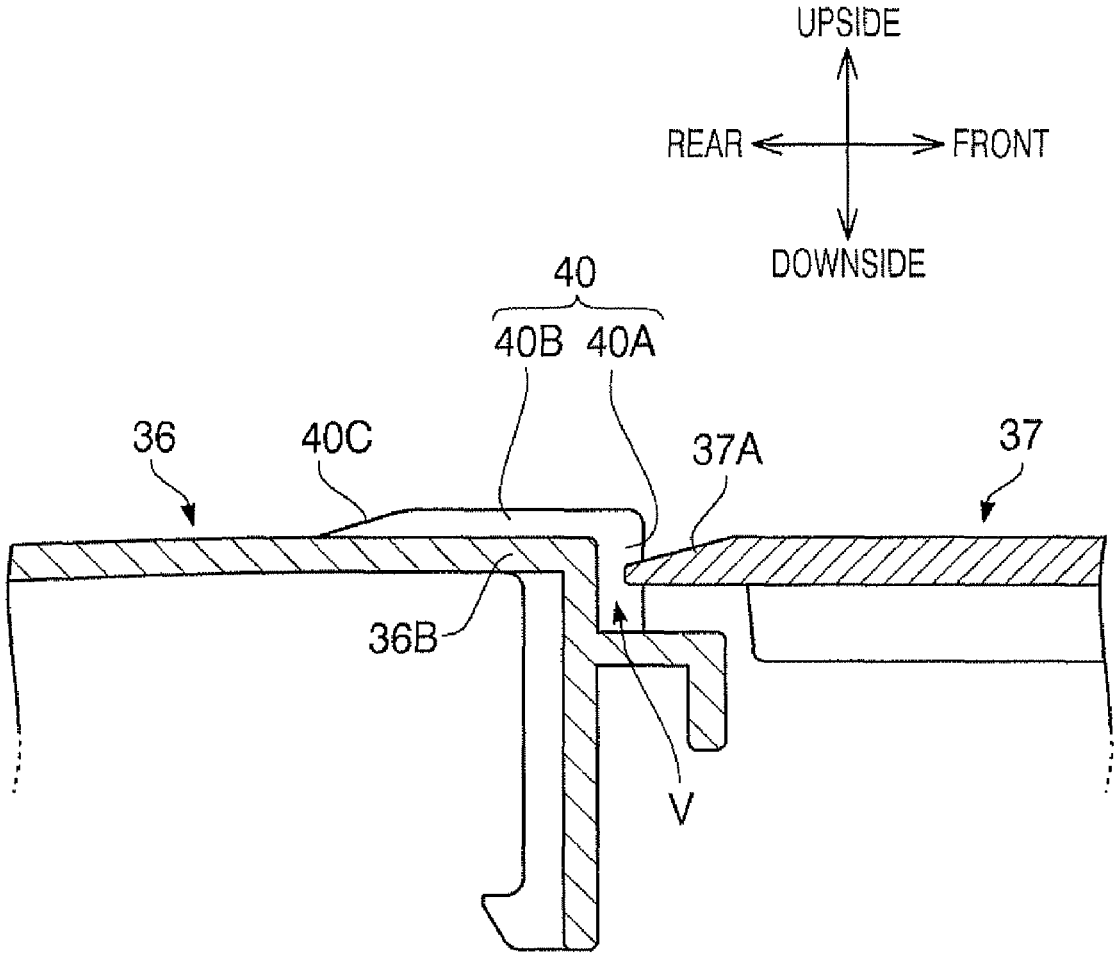
FIG. 6 is a cross-sectional view showing the mutually facing portions of the catch tray and the front cover along an X-X plane shown in FIG. 5 in the embodiment according to one or more aspects of the present invention.

Next, a relationship between the front cover 37 and the catch tray 36 will be described with reference to FIGS. 3 to 6. FIG. 3 is a perspective view of the device main body 2 in a state where the front cover 37 is closed. FIG. 4 is a perspective view of the device main body 2 in a state where the front cover 37 is opened. FIG. 5 is an enlarged view showing mutually facing portions of the catch tray 36 and the front cover 37. FIG. 6 is a cross-sectional view showing the mutually facing portions of the catch tray 36 and the front cover 37 along an X-X plane shown in FIG. 5.

As described above, the catch tray 36 is formed on the main body casing 4. In addition, the front cover 37 is located in front of the catch tray 36 (at a downstream side of the catch tray 36 in the sheet discharging direction of the sheet 5), and configured to open and close the front face of the main body casing 4 therewith.

Specifically, the front cover 37 is as large as to cover more than an upper half of the front face of the main body casing 4, and shows a rectangular shape when viewed from a front side thereof. Additionally, a lower end portion of the front cover 37 is attached to a side of the main body casing 4 with an attaching pin 52 (see FIG. 2). The front cover 37 is supported rotatably around the attaching pin 52. Thereby, when the front cover 37 is closed in a manner rotated around the attaching pin 52, as shown in FIG. 3, an opening 4A at the front face of the main body casing 4 is closed with the front cover 37. Meanwhile, as illustrated in FIG. 4, when an upper end of the front cover 37 is pulled and the front cover 37 is tilted substantially by 90 degrees around the attaching pin 52 as a supporting point, the opening 4A is opened. In this state, through the opening 4A, the process cartridge 17 can be attached to and detached from the main body casing 4.

Further, at a lower portion of the front cover 37, a manual feed slit 53 is formed substantially in a center of the front cover 37 in a width direction to penetrate the front cover 37 in a front-to-rear direction. The manual feed slit 53 is configured to be closed with a manual feed cover 38. The manual feed cover 38 is supported rotatably around a lower end thereof. When the manual feed cover 38 is opened and a sheet 5 is inserted through the manual feed slit 53, the sheet 5 is conveyed to the registration rollers 13.

When the front cover 37 is closed, an upper rear end of the front cover 37 (hereinafter, simply referred to as a facing portion 37A of the front cover 37) and a front end of the catch tray 36 (hereinafter, simply referred to as a facing portion 36B of the catch tray 36) face each other, and upper faces of the facing portions 37A and 36B are substantially in the same plane (see FIG. 2).

In the present embodiment, the facing portion 37A of the front cover 37 overlaps the facing portion 36B of the catch tray 36 when viewed in the right-to-left direction of the image forming device 1. Specifically, as shown in FIG. 5, the facing portion 36B of the catch tray 36 has portions protruded in the sheet discharging direction in a central region thereof. Meanwhile, the facing portion 37A of the front cover 37 has a portion recessed in the sheet discharging direction that corresponds to the aforementioned protruded portions of the facing portion 36B of the catch tray 36.

More specifically, the facing portion 3613 of the catch tray 36 is provided with a plurality of ribs 40 and 41 aligned in the right-to-left direction at intervals of a predetermined distance. Among the ribs 40 and 41, central ribs 40, which are provided in a central region of the facing portion 36B (i.e., in a region facing the recessed portion of the facing portion 37A of the front cover 37), form the aforementioned protruded portions of the facing portion 36B of the catch tray 36. Each of the central ribs 40 includes a first rib 40A protruded from an end face of the facing portion 36B in the sheet charging direction and a second rib 40B protruded from a top face of the facing portion 36B. The second rib 40B is configured such that an upper face thereof is higher than an upper face of the front cover 37. The first rib 40A and the second rib 40B are formed integrally with their ends joined together. It is noted that a rear end of the second rib 40B includes a tapered surface 40C tilted to get lower toward a rear side thereof (see FIG. 6).

On the other hand, outer ribs 41 are provided at both ends of the central region of the facing portion 36B in the right-to-left direction. The outer ribs 41 are different from the central ribs 40 in that each of the outer ribs 41 has only a portion protruded from the upper face of the facing portion 363 and a front end thereof is in the same plane as the front end of the facing portion 36B. Since the facing portion 37A of the front cover 37 and the facing portion 36B of the catch tray 36 are configured as above, as illustrated in FIG. 6, the both sides of the facing portion 37A of the front cover 37 in the right-to-left direction overlap the first ribs 40A of the facing portion 36B of the catch tray 36 when viewed in the right-to-left direction of the image forming device 1. When the image forming device 1 is viewed from an upper side thereof a gap V between the catch tray 36 and the front cover 37 is partially deviated from a line (indicated by a dashed line F in FIG. 5) along the right-to-left direction.

When both right and left ends of the recessed portion of the facing portion 37A are angular, the front end of the sheet 5 discharged becomes likely to get stuck with one or both of the right and left ends of the recessed portion of the facing portion 37A. In order to avoid such a problem, in the present embodiment, the both ends of the recessed portion of the facing portion 37A are formed as tapered surfaces 39 tilted inward so as to be closer to each other toward front sides thereof.

(Sheet Bending Member)

Figure 7:
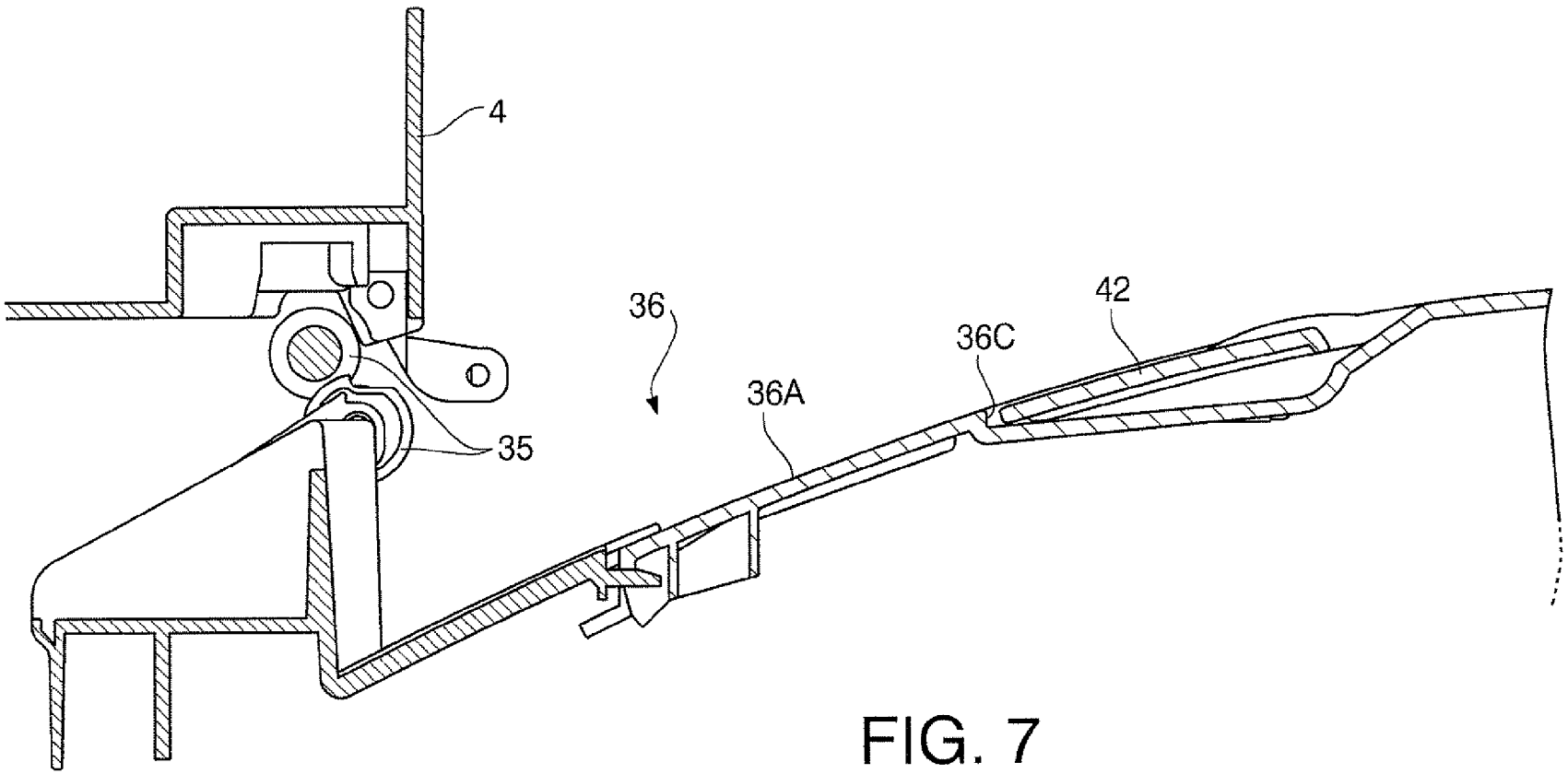
FIG. 7 is a cross-sectional side view showing a sheet bending member in a lying state in the embodiment according to one or more aspects of the present invention.
Figure 8:
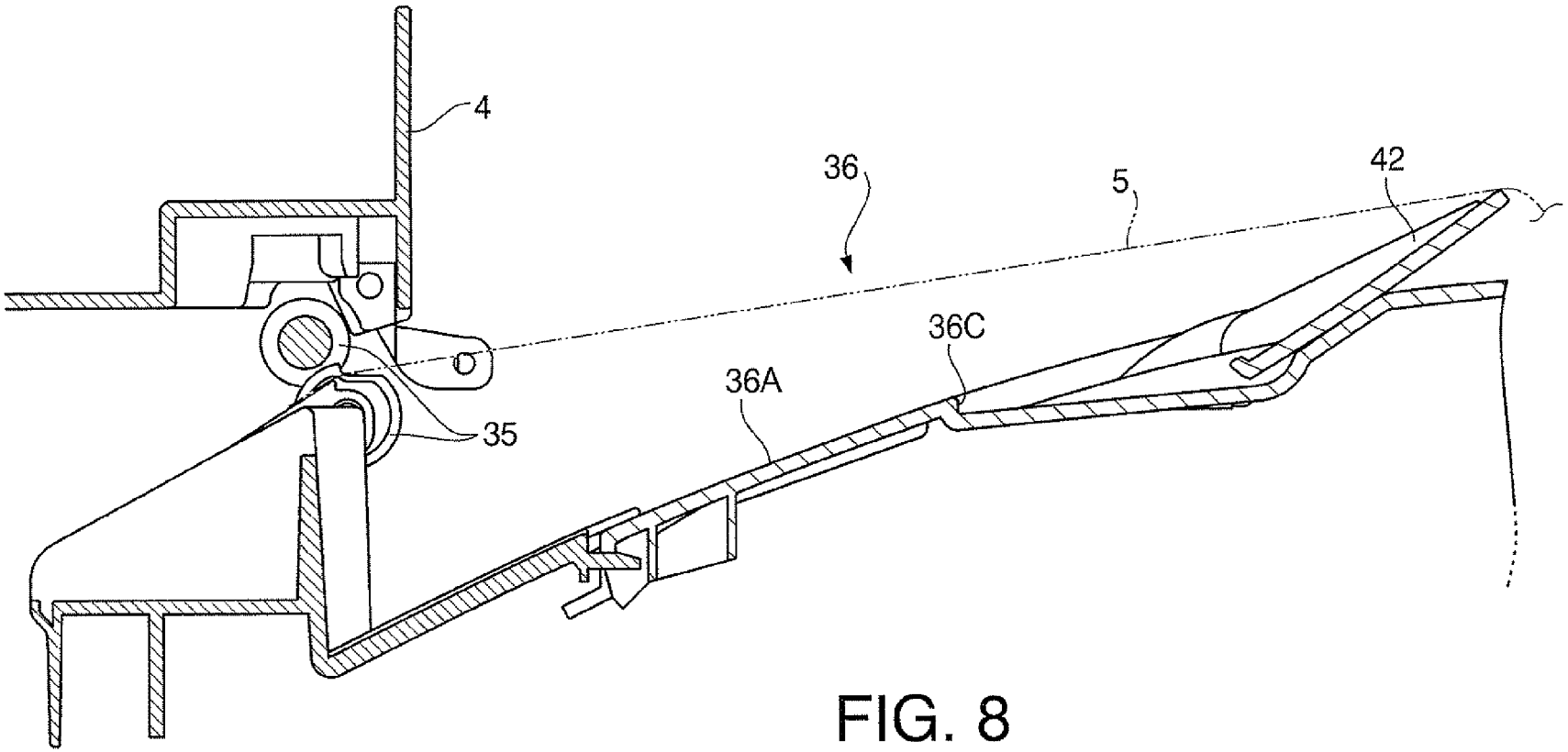
FIG. 8 is a cross-sectional side view showing the sheet bending member in a standing state in the embodiment according to one or more aspects of the present invention.

FIGS. 7 and 8 are cross-sectional side views of a sheet bending member 42 in a lying state and a standing state, respectively. A sheet 5 with an image formed thereon is discharged not only in a state curled around an axis along the right-to-left direction (hereinafter referred to as a first curled state), but sometimes in a state curled around an axis along the sheet discharging direction (hereinafter referred to as a second curled state). When discharged in the second curled state, the sheet 5 with right and left rear ends thereof lifted up is pushed out by a subsequently discharged sheet 5. Therefore, the sheets 5 might not adequately been stacked on the catch tray 5.

The sheet bending member 42 is configured to improve a way the sheets 5 are stacked on the catch tray 36 when the sheets 5 are discharged in the second curled states. Specifically, the sheet bending member 42 is provided at a recessed portion 36C formed substantially in a central region on the catch tray 36, and configured to move between the lying state where the sheet bending member 42 is housed in the recessed portion 36C (see FIG. 7) and the standing state where the sheet bending member 42 projects from the recessed portion 36C (see FIG. 8). In the present embodiment, the sheet bending member 42 is supported rotatably around one end thereof so as to move between the lying state and the standing state. When the sheet bending member 42 is set in the standing state, the sheet 5 in the second curled state is bent with the front end thereof down by the sheet bending member 42 such that the right and left rear ends are not lifted upward (see FIG. 8). Thereby, it is possible to improve the way the sheets 5 in the second curled state are stacked.

(Effects on Discharge of Sheet in Embodiment)

According to the present embodiment, the facing portion 37A of the front cover 37 overlaps the facing portion 36B of the catch tray 36 when viewed in the right-to-left direction of the image forming device 1. Accordingly, the front end of the sheet 5 discharged more hardly enters into to the gap V between the catch tray 36 and the front cover 37 than a known image forming device configured such that a gap V between a catch tray and a front cover is formed linearly along a direction perpendicular to the sheet discharging direction. Thus, it is possible to smoothly discharge the sheet 5.

In particular, the image forming device 1 of the present embodiment is an in-body discharge type one configured such that the cover 3 is disposed above the catch tray 36 via the discharge space S (especially, see FIG. 2). In this type, the sheet 5 discharged may be in the first curled state after a front end of the sheet 5 butts a lower face of the cover 3, and the front end of the sheet directed down may be likely to is directed to the gap V between the catch tray 36 and the front cover 37. Additionally, the sheet 5 discharged in the first curled state has a central portion thereof lifted by the sheet bending member 42, and thereby the first curled state of thereof is more significant. It results in that the front end of the sheet 5 is more likely to be directed to the gap V. However, despite the above undesired situation, the image forming device 1 of the present embodiment makes it possible to prevent the front end of the sheet 5 from entering into the gap V and to smoothly discharge the sheet 5.

The facing portion 36B of the catch tray 36 has portions protruded in the sheet discharging direction in the central region thereof. Further, the facing portion 37A of the front cover 37 has a portion recessed in the sheet discharging direction in the central region thereof corresponding to the protruded portions of the facing portion 36B of the catch tray 36. Accordingly, in the present embodiment, the front end of the sheet 5 more hardly gets stuck with the facing portion 37A of the front cover 37 than an image forming device configured with a facing portion 36B of a catch tray 36 having a recessed portion and a facing portion 37A of a front cover 37 having a protruded portion. Thus, it is possible to smoothly discharge the sheet 5.

More specifically, the central ribs 40 are provided as the protruded portions in the central region of the facing portion 36B of the catch tray 36. The facing portion 36B may be configured such that an entire central region thereof is protruded to conform to the recessed portion of the facing portion 37A of the front cover 37. However, such a configuration causes a forming error of the entire central region which has a large thickness. On the contrary, in the present embodiment, since the facing portion 36B is configured with a plurality of central ribs 40 to form protruded portions in the central region thereof, the catch tray 36 can be formed more accurately. Therefore, the gap V between the catch tray 36 and the front cover 37 can accurately be configured.

In addition, each of the central ribs 40 includes the first rib 40A protruded from the end face of the facing portion 36B in the sheet charging direction and the second rib 40B protruded from the top face of the facing portion 36B. Further, the first rib 40A and the second rib 40B are formed integrally with their ends joined together. Thereby, the front end of the sheet 5 is lifted up by the second rib 40B before the sheet 5 reaches the facing portion 37A of the front cover 37. Hence, it is possible to further prevent the front end of the sheet 5 from entering into the gap V between the catch tray 36 and the front cover 37. Additionally, since the first rib 40A and the second rib 40B are formed integrally with their ends joined together, it is possible to more smoothly convey the front end of the sheet 5 to a side of the front cover 37 than an image forming device that does not have such a configuration.

(Regarding Extension Tray)

So far, some of known image forming devices having a catch tray formed on a main body casing are configured with an extension tray attached to the upper face of the main body casing to receive a large-sized sheet. The extension tray is fixed in a state extending toward a downstream side of the catch tray in a sheet discharging direction in use of the image forming device. Further, the extension tray is configured to regulate movement of the large-sized sheet in the sheet discharging direction while supporting the front end of the large-sized sheet.

However, in the image forming device having the above extension tray, when the main body casing is requested to be downsized, the extension tray has to be designed to be long in the sheet discharging direction in order to maintain the maximum size of the sheet stackable on the extension tray. However, it unfortunately causes an undesired increase in component cost.

In this regard, the image forming device of the present embodiment is configured to attain downsizing of an extension tray. Specifically, the image forming device 1 includes an extension tray 60, attached to an upper region of the front cover 37, which is configured to extend toward the downstream side of the catch tray 36 in the sheet discharging direction and support the front end of the sheet 5. According to the configuration, the extension tray 60 is attached to the front cover 37 configured to cover, in an openable and closable manner, a side face at a downstream side of the main body casing 4 in the sheet discharging direction. Therefore, the extension tray can be configured to have a smaller length in the sheet discharging direction than a known image forming device having an extension tray provided at a main body casing side. Thus, it is possible to reduce the component cost.

Further, the extension tray 60 has following two structural features.

Structural Feature 1: the extension tray 60 is configured rotatably around a rotational shaft provided at a downstream-side end of the upper face of the front cover 37 in the sheet discharging direction. In addition, through the rotational operation of the extension tray 60, the extension tray 60 is movable between an in-use position in which the extension tray 60 extends toward the downstream side in the sheet discharging direction and an evacuation position in which the extension tray 60 is turned down toward the upper face of the front cover 37. Additionally, the extension tray 60 is configured with a pair of substantially plate-shaped supporting members mutually joined rotatably. Both the supporting members are configured to be movable between an extended state and a folded state. Further, the extension tray 60 is provided with a locking member configured to hold at least one of the extended state and the folded state.

Structural Feature 2: the extension tray 60 is configured rotatably around the rotational shaft provided at the downstream-side end of the upper face of the front cover 37 in the sheet discharging direction. In addition, through the rotational operation of the extension tray 60, the extension tray 60 is movable between the in-use position in which the extension tray 60 extends toward the downstream side in the sheet discharging direction and the evacuation position in which the extension tray 60 is turned down toward the side of the upper face of the front cover 37. Further, the extension tray 60 includes a grip formed by notching the extension tray 60.

It is noted that at least one of the aforementioned structural features of the extension tray 60 establishes an independent invention to solve the above problem related to the extension tray, even though the image forming device 1 is not configured as mentioned in the above description regarding the front cover 37 and the catch tray 36.

Figure 9:
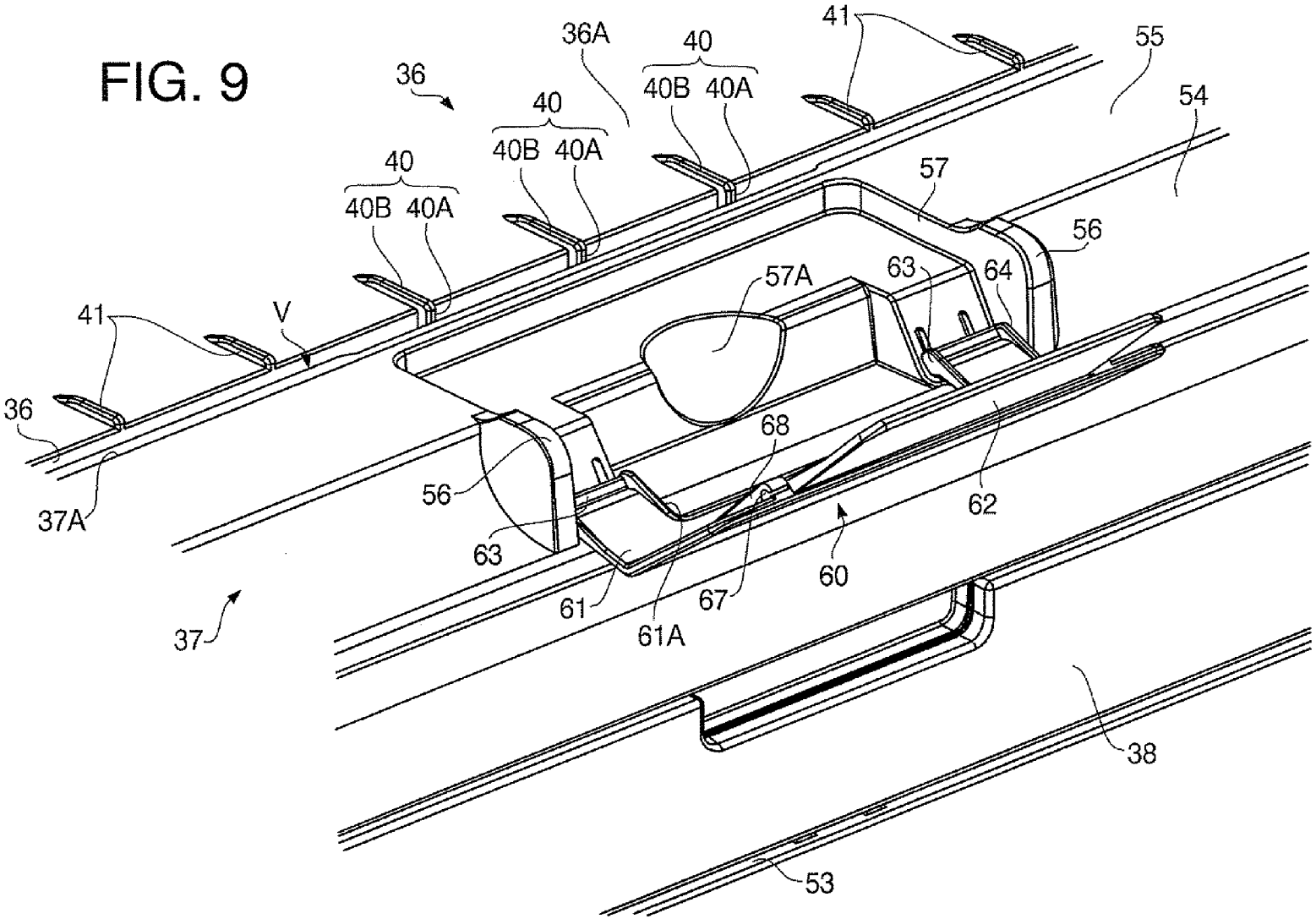
FIG. 9 is a perspective view showing an extension tray in the embodiment according to one or more aspects of the present invention.
Figure 10:
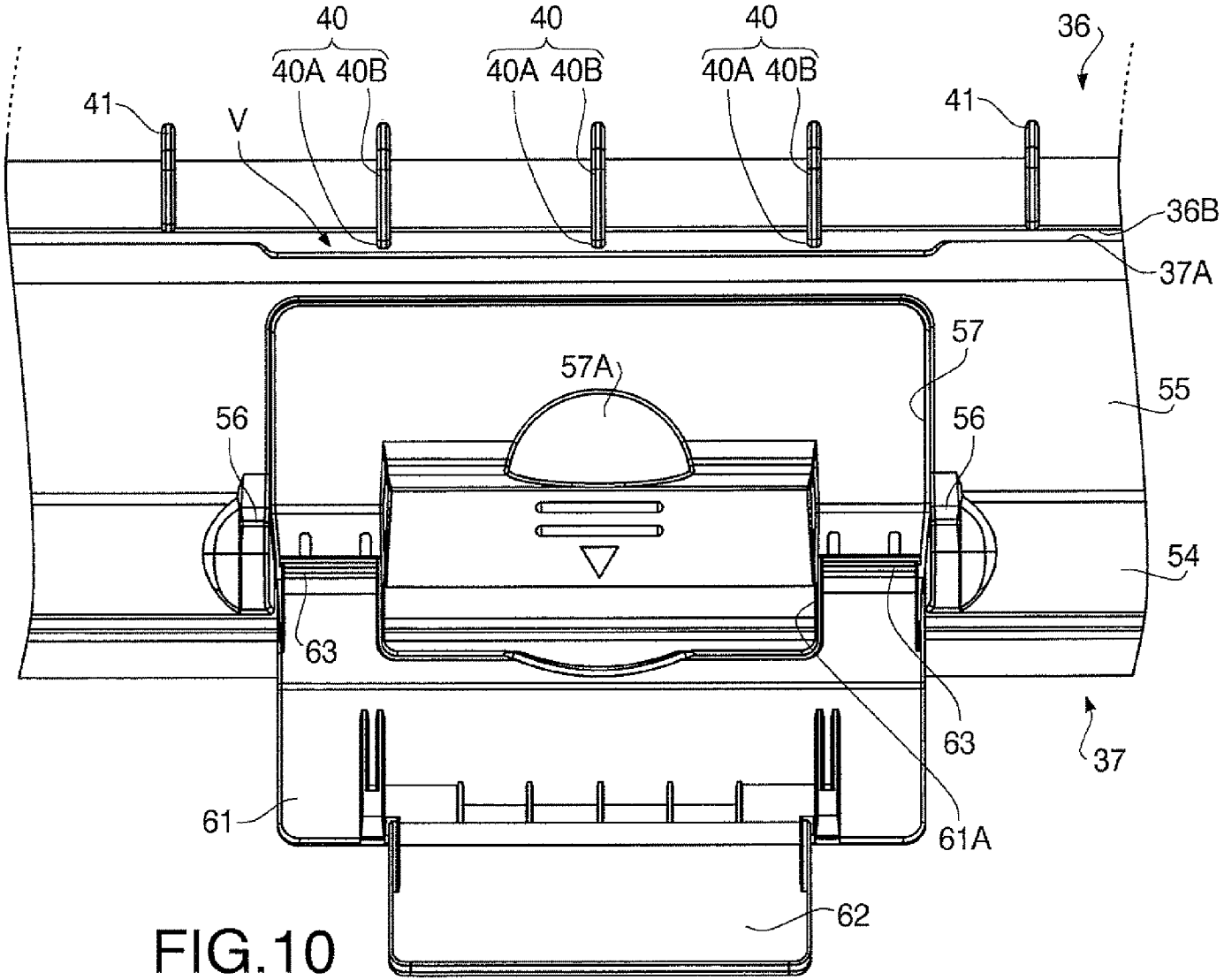
FIG. 10 is a top view showing the extension tray in the embodiment according to one or more aspects of the present invention.
Figure 11:
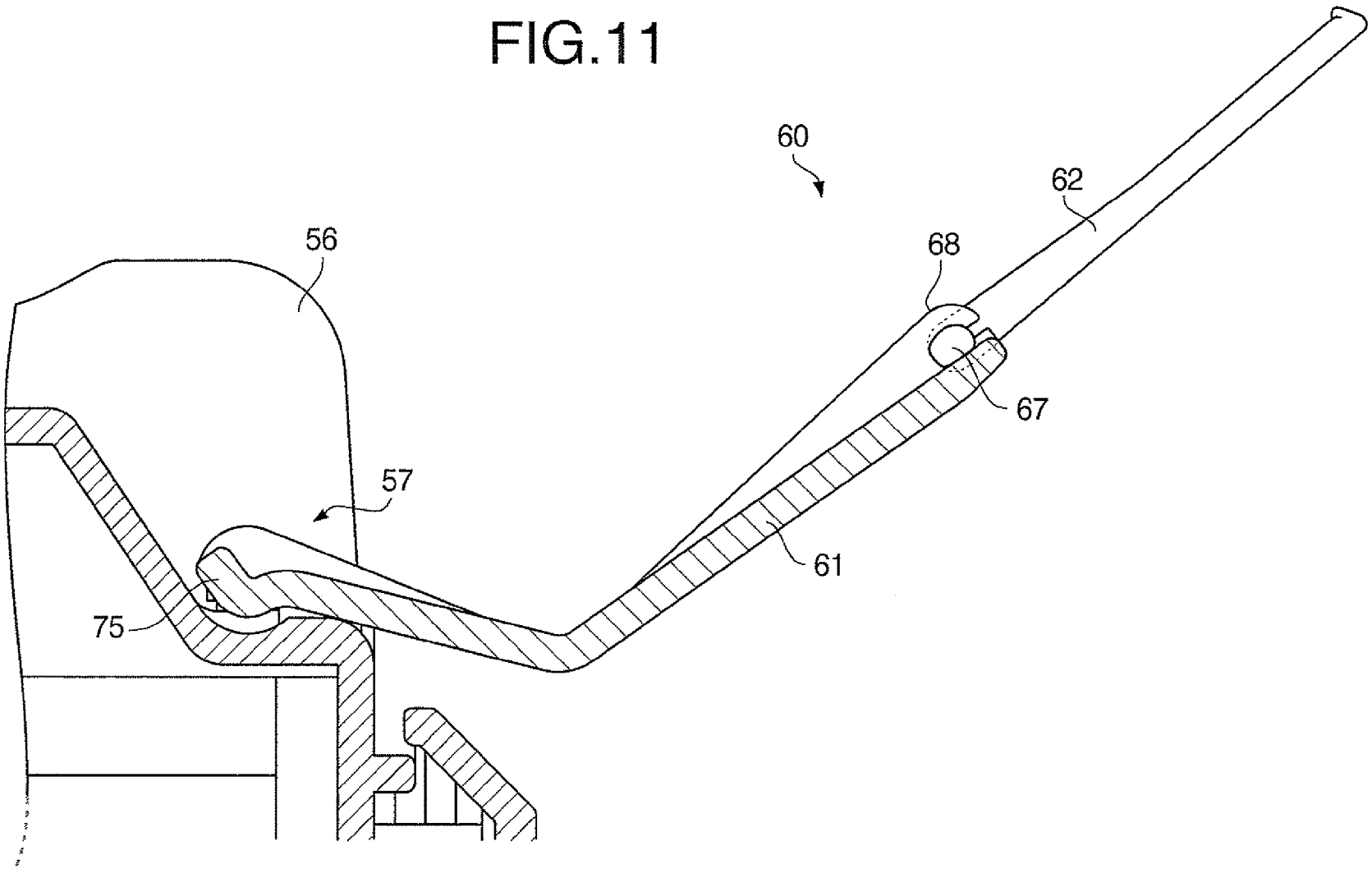
FIG. 11 is a side view showing the extension tray in an in-use position in the embodiment according to one or more aspects of the present invention.

FIG. 9 is a perspective view showing the extension tray 60. FIG. 10 is a top view showing the extension tray 60. FIG. 11 is a side view of the extension tray 60 in the in-use position.

Figure 12:
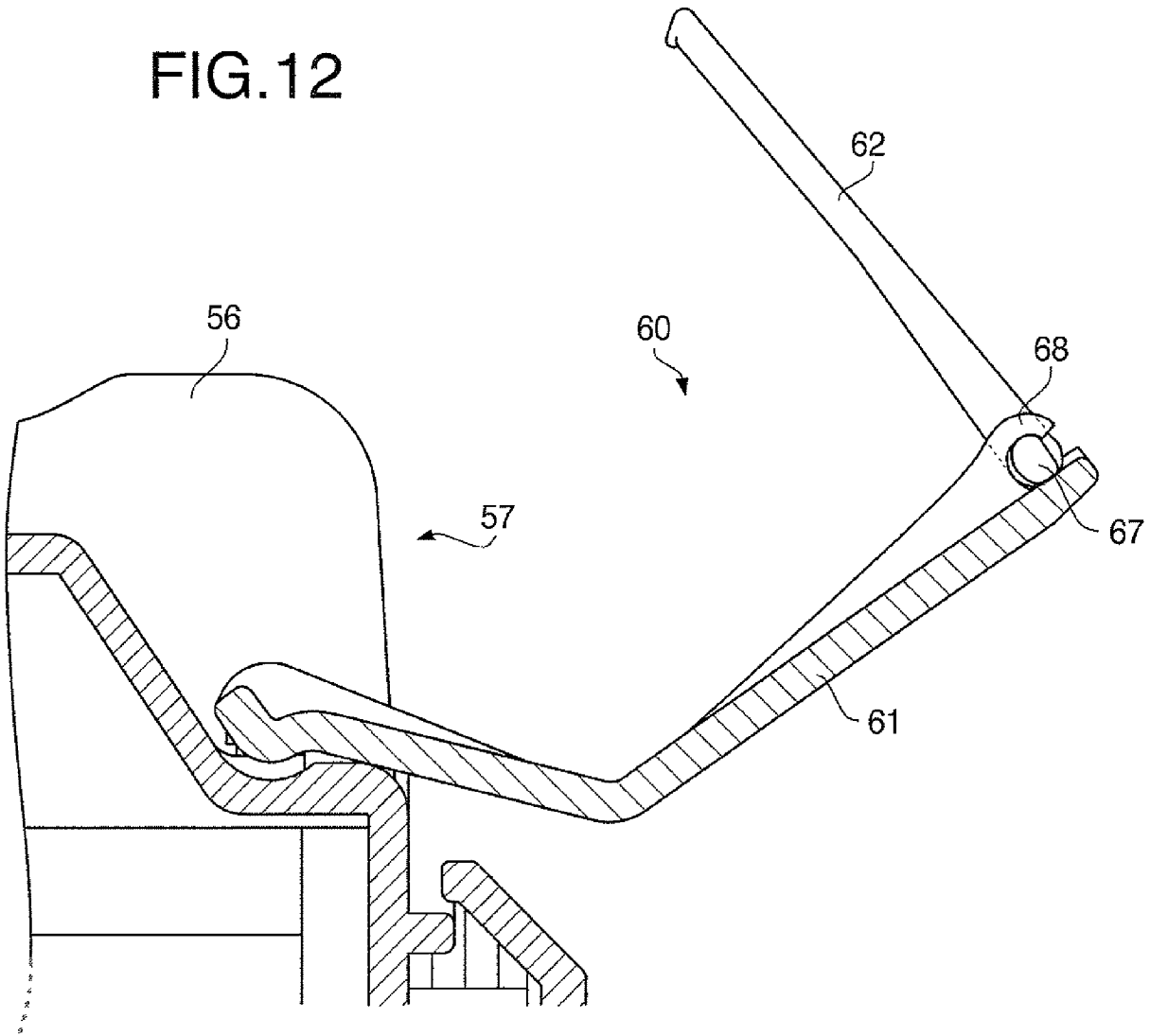
FIG. 12 is a side view of the extension tray in the middle between the in-use position and an evacuation position in the embodiment according to one or more aspects of the present invention.

FIG. 12 is a side view of the extension tray 60 in the middle between the in-use position and the evacuation position.

In an upper region of the front cover 37 that corresponds to the catch tray 36, an inclined surface 54 is formed, which is tilted to get lower toward a downstream side thereof in the sheet discharging direction. The inclined surface 54 is formed in a region from a downstream side to an upstream side on the front cover 37. At an upstream-side end of the inclined surface 54, a connection surface 55 is formed, which smoothly continues into the sheet loading surface 36A of the catch tray 36 in a state where the front cover 37 is closed.

In addition, the inclined surface 54 includes a pair of right and left ribs 56 provided in a region one third as long as a width of the inclined surface 54 away from both ends of the inclined surface 54 in a width direction of the inclined surface 54. Each of the ribs 56 is protruded along the front-to-rear direction. An upper end face of the rib 56 is tilted to get lower toward a front side thereof, such that a rear end thereof smoothly continues into the sheet loading surface 36A via the connection surface 55. Additionally, the rib 56 is protruded from the inclined surface 54 to get higher toward the front side thereof, so as to keep a gap between the sheet 5 on the upper end face of the rib 56 and the inclined surface 54. Further, in a central region of the inclined surface 54 in a width direction thereof, a rectangular recess 57 that accommodates the extension tray 60 is provided.

The inclined surface 54 includes the pair of ribs 56 disposed at both sides thereof in the width direction thereof via the recess 57. Further, as illustrated in FIG. 2, a front end of the operation unit 50 of the lower cover 3B and the front end face of the front cover 37 are disposed substantially in the same position in the front-to-rear direction. A region between a lower front end of the operation unit 50 and a front end of the inclined surface 54 of the front cover 37 is a sheet ejection outlet 58 from which the sheet 5 is discharged.

As shown in FIGS. 9 and 10, the extension tray 60 is configured with a first supporting plate 61 and a second supporting plate 62. The first supporting plate 61 is slightly smaller than the recess 57, and formed like a rectangular plate bent halfway as a whole. Further, in a lower end region of the first supporting plate 61, a pair of right and left axis portions 63 each of which protrudes toward both end sides in a width direction thereof. The both axis portions 63 are engaged with respective bearing portions 64 provided in front end regions of right and left inner surfaces of the recess 57. Thereby, the first supporting plate 61 is supported to be rotatable around the axis portions 63 with respect to the front cover 37. The axis portions 63 are provided in the vicinity of a downstream-side end in the sheet discharging direction on the front cover 37. In other words, the axis portions 63 are disposed in the vicinity of a lower end of the sheet ejection outlet 58.

In FIG. 2, a turning trajectory of a leading edge of the first supporting plate 61 is shown by an alternate long and short dash line K. Thus, a height dimension of the sheet ejection outlet 58 (i.e., a distance between the lower front end of the operation unit 50 and the front end of the inclined surface 54 of the front cover 37) is designed to be much longer than a rotation radius of the first supporting plate 61. The first supporting plate 61 is configured to be rotatable between the in-use position in which the first supporting plate 61 extends toward the downstream side in the sheet discharging direction (see FIGS. 9, 10, and 11) and the evacuation position in which the first supporting plate 61 is turned down toward the upper face of the front cover 37 (see FIGS. 1, 3, and 5). In the evacuation position, the first supporting plate 61 is fitted in the recess 57 with an outer surface thereof (i.e., a surface of the first supporting plate 61 exposed outside in the evacuation position) substantially in the same plane as the inclined surface 54 and the connection surface 55.

In the meantime, in the present embodiment, the first supporting plate 61 includes the grip formed therein. Specifically, the first supporting plate 61 includes an opening 61A formed by notching a fixed end of the first supporting plate 61 such that an operator can insert his finger thereinto. Further, the recess 57 includes a dent 57A formed at a bottom face thereof. As shown in FIG. 1, when the extension tray 60 is in the evacuation position, the operator can insert his finger into the opening 61A and the dent 57A and pull an internal surface of the extension tray 60 toward the front side to set the extension tray 60 to the in-use position. In this way, when the extension tray 60 is pulled forth using a part thereof notched, it is possible to downsize a location space for elements related to the extension tray 60.

The second supporting plate 62 is rectangular with two side lengths thereof (in a width direction and a forth-extending direction thereof) shorter than those of the first supporting plate 61. At one end of the second supporting plate in the forth-extending direction thereof, a pair of axis portions 67, each of which protrudes toward a respective side in the width direction of the second supporting plate 62, is provided at both ends in the right-to-left direction. Each of the axis portions 67 is engaged with a respective one of a pair of bearing portions 68 provided in a protruded manner at a free end of the first supporting plate 61 on an inner surface (i.e., a surface hidden inside in the evacuation position) of the first supporting plate 61. Thereby, the second supporting plate 62 is supported rotatably with respect to the first supporting plate 61. Further, thereby, the second supporting plate 62 is movable between in a folded state and an extended state. Here, the folded state is a state where the second supporting plate 62 wholly overlaps the inner surface at the free end of the first supporting plate 61 (see FIGS. 1, 3, and 5). Additionally, the extended state is a state where the second supporting plate 62 is extended in the forth-extending direction from the free end of the first supporting plate 61 (see FIGS. 9, 10, and 11). When the first supporting plate 61 and the second supporting plate 62 are in the folded state, the first supporting plate 61 can be rotated back and forth without interference between the second supporting plate 62 and the operation unit 50. In addition, when the first supporting plate 61 and the second supporting plate 62 are in the folded state, both the plates 61 and 62 can be housed in the recess 57.

As illustrated in FIG. 11, each of the axis portions 67 has an oval cross-section. Each of the bearing portions 68 has an oval hole into which a corresponding one of the axis portions 67 is inserted, and a split distal end. Thereby, when both the supporting plates 61 and 62 are moved from the folded state or the extended state, as illustrated in FIG. 12, the bearing portions 68 are elastically deformed to be push-opened by the respective axis portions 67. In the above locking manner, since both the supporting plates 61 and 62 are held in one of the extended state and the folded state, it is possible to avoid a play therebetween. It is noted that the first supporting plate 61 can be held by the front cover 37 between the evacuation position and the in-use position in the same locking manner as described above to avoid a play between the first supporting plate 61 and the front cover 37.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

(Modifications)

The image forming device 1 may include a printing device provided only with a printer function as well as the aforementioned multifunction peripheral. Further, the image forming device 1 is not limited to an electrophotographic type one such as a laser printer, and may be an inkjet type one.

In the aforementioned embodiment, the facing portion 37A of the front cover 37 has a single recessed portion. However, the facing portion 37A of the front cover 37 may have a plurality of recessed portions.

What is claimed is:

1. An image forming device configured to form an image on a sheet, comprising:

a main body casing; a catch tray provided on the main body casing to be loaded with the sheet discharged in a first direction with the image formed thereon; and a cover configured to cover a downstream-side face of the main body casing in the first direction in an openable and closable manner, wherein the catch tray is disposed such that a downstream-side end thereof in the first direction faces an upstream-side end of the cover in the first direction, wherein the downstream-side end of the catch tray and the upstream-side end of the cover mutually overlap in a state where the cover is closed when viewed from a second direction perpendicular to both the first direction and a vertical direction, wherein the downstream-side end of the catch tray includes a protruded portion configured to protrude in the first direction, the protruded portion of the catch tray including a plurality of first ribs configured to protrude in the first direction, and wherein the upstream-side end of the cover includes a recessed portion configured to be recessed in the first direction, the recessed portion facing the protruded portion.

2. The image forming device according to claim 1, wherein the downstream-side end of the catch tray includes a plurality of second ribs provided thereon to extend in the first direction.

3. The image forming device according to claim 2, wherein at least one of the first ribs continues into a corresponding one of the second ribs.

4. The image forming device according to claim 2, wherein each of the second ribs includes a tapered surface tilted to get lower toward an upstream-side thereof in the first direction.

5. The image forming device according to claim 2, wherein each of the second ribs includes an upper face located above an upper face of the cover in the vertical direction.

6. The image forming device according to claim 3, wherein the first ribs and the second ribs are aligned at intervals of a predetermined distance in the second direction.

7. The image forming device according to claim 1, further comprising a sheet bending member provided on the catch tray to bend the sheet discharged onto the catch tray with a leading end of the sheet in the first direction down.

8. The image forming device according to claim 1, further comprising a document scanning unit configured to scan a document, the document scanning unit being provided above the catch tray via a discharge space formed therebetween, wherein the discharge space is configured to accommodate the sheet discharged thereinto and stacked on the catch tray.

9. An image forming device configured to form an image on a sheet, comprising:

a main body casing; a catch tray;

a discharge unit configured to discharge a sheet onto the catch tray in a first direction, the discharge unit being disposed at an upstream side relative to the catch tray in the first direction; and a cover configured to cover a side face of the main body casing in the first direction in an openable and closable manner, wherein the catch tray comprises:

a first protruded portion that has a downstream end protruding out of a downstream end of the catch tray in the first direction; and a second protruded portion that has a downstream end disposed in a same position in the first direction as the downstream end of the catch tray, wherein the first and second protruded portions of the catch tray comprise a plurality of ribs configured to protrude in the first direction, wherein the cover comprises a recessed portion formed at an upstream end of the cover in the first direction to be recessed and face the first protruded portion in the first direction.

10. The image forming device according to claim 9, further comprising a sheet bending member provided on the catch tray to bend the sheet discharged onto the catch tray with a leading end of the sheet in the first direction down.

11. The image forming device according to claim 9, further comprising a document scanning unit configured to scan a document, the document scanning unit being provided above the catch tray via a discharge space formed therebetween, wherein the discharge space is configured to accommodate the sheet discharged thereinto and stacked on the catch tray.

* * * * *